US012305138B1

(12) United States Patent
Hershberger et al.

(10) Patent No.: US 12,305,138 B1
(45) Date of Patent: May 20, 2025

(54) PETROLEUM IMPACTED ABSORBENT MATERIAL HANDLING AND DISPOSAL SYSTEMS AND METHODS

(71) Applicant: Emerald Environmental Services, Inc., Kent, OH (US)

(72) Inventors: Scott Hershberger, Kent, OH (US); Brian T. Grimm, Kent, OH (US)

(73) Assignee: Emerald Environmental Services, Inc., Kent, OH (US)

( * ) Notice: Subject to any disclaimer, the term of this patent is extended or adjusted under 35 U.S.C. 154(b) by 0 days.

(21) Appl. No.: 18/642,078

(22) Filed: Apr. 22, 2024

(51) Int. Cl.
*C10L 5/44* (2006.01)
*C10L 7/02* (2006.01)

(52) U.S. Cl.
CPC ..... *C10L 5/445* (2013.01); *C10L 7/02* (2013.01); *C10L 2200/0453* (2013.01); *C10L 2200/0469* (2013.01)

(58) Field of Classification Search
CPC .... C10L 5/44; C10L 5/445; C10L 7/02; C10L 2200/0453; C10L 2200/0469
See application file for complete search history.

(56) References Cited

U.S. PATENT DOCUMENTS 5,730,868 A * 3/1998 Cordani ..... B01D 17/0202 210/924
6,312,528 B1 * 11/2001 Summerfield ..... B08B 3/104 134/40
11,339,341 B1 * 5/2022 McCarthy ..... C10L 5/365
2003/0020043 A1 * 1/2003 Barresi ..... B01J 20/22 252/194
2012/0031847 A1 * 2/2012 Shook ..... B01J 20/223 210/691
2012/0046419 A1 * 2/2012 Chung ..... C02F 1/285 525/333.7
2017/0204343 A1 * 7/2017 Almanza Vega ..... C02F 1/681
2019/0185774 A1 * 6/2019 Tischendorf ..... C10L 5/445
2021/0394719 A1 * 12/2021 Boroughf ..... F16N 31/002
2022/0307164 A1 * 9/2022 McCarthy ..... B01D 39/1623
2024/0336860 A1 * 10/2024 McCarthy ..... C10L 5/361
2024/0409835 A1 * 12/2024 McCarthy ..... C10L 5/361

* cited by examiner

*Primary Examiner* — Ellen M McAvoy
(74) *Attorney, Agent, or Firm* — Renner, Kenner, Greive, Bobak, Taylor & Weber Co., LPA

(57) ABSTRACT

A method of generating an alternative fuel, the method including providing at least one petroleum impacted material, identifying and classifying the at least one petroleum impacted material, wherein the at least one petroleum impacted material is classified as acceptable or unacceptable, optionally, rejecting any of the at least one petroleum material classified as unacceptable, handling any of the at least one acceptable petroleum impacted material, wherein handling includes dispersing the at least one acceptable petroleum impacted material in an aging container, and aging the at least one acceptable petroleum impacted material until a predetermined flashpoint value is obtained to thereby provide an aged petroleum impacted material as the alternative fuel.

13 Claims, 1 Drawing Sheet

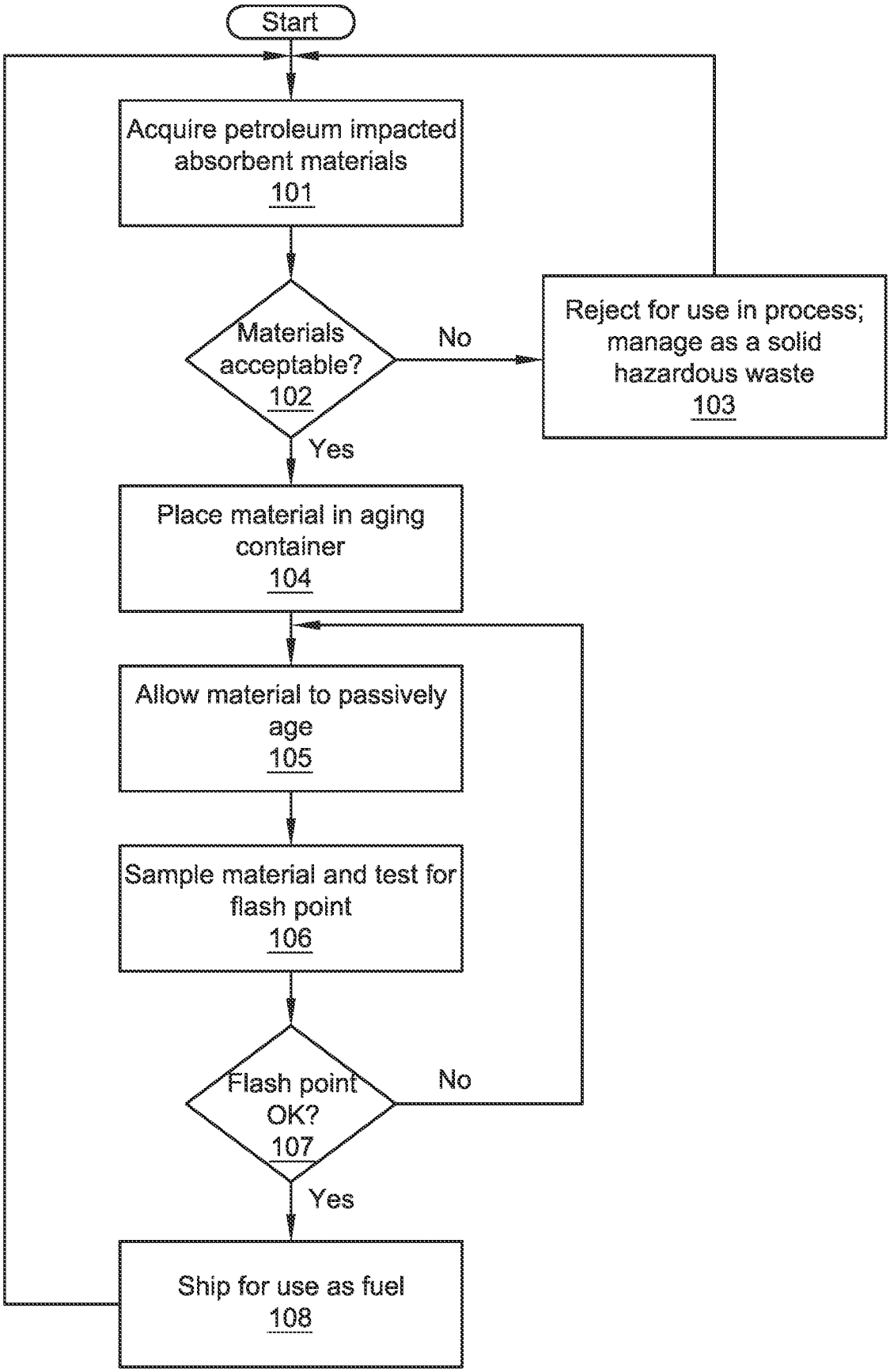
Start
Acquire petroleum impacted absorbent materials
101
Materials acceptable?
102
No
Reject for use in process; manage as a solid hazardous waste
103
Yes
Place material in aging container
104
Allow material to passively age
105
Sample material and test for flash point
106
Flash point OK?
107
No
Yes
Ship for use as fuel
108

PETROLEUM IMPACTED ABSORBENT MATERIAL HANDLING AND DISPOSAL SYSTEMS AND METHODS

FIELD OF THE INVENTION

Embodiments of the present invention provide systems and methods for handling and managing of petroleum impacted absorbent materials in lieu of disposal. In particular embodiments, the present invention provides systems and methods that avoid hazardous waste generation, transportation, and treatment.

BACKGROUND OF THE INVENTION

The management of petroleum impacted materials, in particular absorbent materials impacted by petroleum and petrochemical based products, presents unique challenges as certain modes of transporting, handling, storing, and treating the material may create a regulated hazardous waste subject to stringent regulations and controls.

Oil and fuel spill kits are commonly found in or near facilities involved in the dispensing of oil and fuel products including motor oil, gasoline, kerosene, diesel, etc. Amongst other equipment, these spill kits include absorbents to help remediate and contain spills. Common absorbents include loose absorbents including organic and inorganic based materials, polyethylene pads, and polyethylene booms, among others. Once these absorbents become impacted by petroleum products they may be considered a hazardous waste if they have come into contact with a listed hazardous waste, or if the petroleum impacted absorbent exhibits characteristics of hazardous waste. Once classified as a hazardous waste, disposal of the petroleum impacted waste becomes more costly and resource intensive to manage including storage, transportation, and disposal. Thus, there is a need for improved methods of handling and managing petroleum impacted materials as a product without being classified as a hazardous waste while being compatible with increasing demand for improved environmental, social, and governance (ESIG) practices.

SUMMARY OF THE INVENTION

One or more embodiments of the present invention provide a method of generating an alternative fuel, the method including providing at least one petroleum impacted material, identifying and classifying the at least one petroleum impacted material, wherein the at least one petroleum impacted material is classified as acceptable or unacceptable, optionally, rejecting any of the at least one petroleum material classified as unacceptable, handling any of the at least one acceptable petroleum impacted material, wherein handling includes dispersing the at least one acceptable petroleum impacted material in an aging container, and aging the at least one acceptable petroleum impacted material until a predetermined flashpoint value is obtained to thereby provide an aged petroleum impacted material as the alternative fuel.

BRIEF DESCRIPTION OF THE DRAWINGS

FIG. 1 is a flow chart illustrating the sequence of steps associated with a method of handling and managing a petroleum impacted material to generate an alternative fuel according to an embodiment of the present invention

DETAILED DESCRIPTION OF ILLUSTRATIVE EMBODIMENTS

Introduction

Embodiments of the invention are based, at least in part, on the discovery of improved methods for handling and managing petroleum impacted materials. In particular, embodiments of the present invention provide methods of handling and managing petroleum impacted materials that avoid being classified as a hazardous waste subject to further regulation. Specifically, embodiments of the present invention provide methods of handling and management of petroleum impacted materials where final disposition is accomplished by providing the previously petroleum impacted materials as an alternative fuel. As used herein, an alternative fuel is a material, including oily debris, that is accepted by an alternative energy facility for use as a fuel to produce energy for producing power or other energy recovery purposes.

Petroleum Impacted Materials

Embodiments of the invention include the use of petroleum impacted materials that are typically disposed as waste. In some embodiments, petroleum impacted materials is defined as an absorbent material that has been contacted with petroleum or other petroleum products. Typically, contact between the absorbent material and the petroleum or other petroleum products occurs when remediating a spill of the petroleum or other petroleum products, whereby the absorbent material absorbs the petroleum or other petroleum products. Petroleum or other petroleum products include gasoline, diesel, jet fuels, kerosene, unused motor oils, hydraulic oils, and otherwise uncontaminated petroleum products. Used petroleum products including, for example, waste oils are not suitable for use in the present invention. Absorbent materials suitable for use with embodiments of the invention are capable of absorbing petroleum or other petroleum products. Absorbent materials suitable for use with embodiments of the invention further have a net heating value of 3500 Btu/lb or greater. In other embodiments, the absorbent materials have a net heating value of 4000 Btu/lb or greater. In other embodiments, the absorbent materials have a net heating value of 4500 Btu/lb or greater. In other embodiments, the absorbent materials have a net heating value of 5000 Btu/lb or greater.

Examples of absorbent materials suitable for use in the present invention typically include loose absorbents derived from biomass, polyethylene pads, and polyethylene booms. Loose absorbents derived from biomass are free from inorganic materials including clays and other non-BTU producing solids. Biomass suitable for use as loose absorbents includes ground corn cob, peat moss, coconut shells, lignin, sugarcane bagasse, and other biomass with a net heating value of 3500 Btu/lb or greater that are not comingled with inorganic materials. In other embodiments, the absorbent materials have a net heating value of 4000 Btu/lb or greater. In other embodiments, the absorbent materials have a net heating value of 4500 Btu/lb or greater. In other embodiments, the absorbent materials have a net heating value of 5000 Btu/lb or greater.

As discussed above, in order for petroleum impacted materials to be managed of according to methods of the present invention, absorbent material and petroleum or other petroleum products are unused or free from contamination that would otherwise make the blend be classified as a solid or hazardous waste and for use as an alternative fuel material. Contamination of absorbent materials may be avoided by not commingling different types of absorbents. Further, when remediating a spill of petroleum or other petroleum products, care should be taken to avoid commingling petroleum impacted materials with used or otherwise contaminated petroleum or other petroleum products that may or may not be compatible with the present invention.

Handling and Management Methods and Systems

The methods according to the present invention may be described according to the following. In some embodiments, a source of petroleum or other petroleum products, which may include for example fuel stations, fuel depots, fuel storages, maintenance facilities, large equipment, amongst others, is equipped with a spill remediation kit including at least one absorbent material. The source of petroleum or other petroleum products experiences a spill or other discharge of petroleum or other petroleum products into the environment that requires remediation. An operator or other person uses at least one absorbent material provided in the spill remediation kit to clean and remediate the discharge according to best practices and to thereby convert the at least one absorbent material into a petroleum impacted material.

In these and other embodiments, the petroleum impacted waste is stored in a compliant container. Compliant containers are transport vessels that meet the Department of Transportation (DOT) standards for safely shipping materials such as petroleum impacted materials. Petroleum impacted materials may be classified as flammable solids which may be subject to DOT hazard classification for shipping purposes. Compliant containers may include drums, roll-off boxes, and other DOT-approved vessels. Once stored in a compliant container, the petroleum impacted material waste may be transported to a conditioning facility for further handling.

In these and other embodiments, a conditioning facility is described as a facility capable of receiving petroleum impacted material and later managing the petroleum impacted material as an alternative fuel. Advantageously, the conditioning facility does not provide any treatment to the petroleum impacted material which would thereby generate a hazardous waste classification and permitting.

At the conditioning facility, the petroleum impacted material may be assessed or inspected to verify compliance and conformance with the present invention. Typically, this is accomplished, in part, by analyzing a sample of the petroleum impacted material included during shipment of the petroleum impacted material. Qualities of interest include visual identification of the type of absorbent material, the presence of absorbed petroleum or other petroleum products, moisture content, and flashpoint. Once the petroleum impacted material is investigated or characterized, it may be approved for further handling or separated for waste management and handling or rejection by the conditioning facility.

Upon being approved for further handling, the petroleum impacted material may be dispersed in an aging container for handling and storage. An aging container may be described as a rigid container suitable for holding petroleum impacted materials while preventing precipitation and other environmental conditions from impacting the petroleum impacted material and release of material to the environment. In some embodiments, the aging container is a roll-off container with a lid for covering the held petroleum impacted material. In some embodiments the lid is selected from a steel or plastic lid. In some embodiments the roll-off container has a storage volume of 10 cubic yards or greater. In other embodiments, 15 cubic yards or greater. In other embodiments, 20 cubic yards or greater. In other embodiments, 30 cubic yards or greater. In other embodiments, 40 cubic yards or greater.

In some embodiments, petroleum impacted material may be transferred from the compliant container to the aging container according to conventional material handling practices and procedures. In these and other embodiments, material handling may include using a hopper connected to a tow motor or forklift which effectively disperses the petroleum impacted material in the aging container. While transferring petroleum impacted material to the aging container it is important to avoid compacting the petroleum impacted waste. Accordingly, the aging container must not be overfilled. By avoiding compaction, the petroleum impacted material is able to passively ventilate and reduce moisture. Consolidating petroleum impacted material in an aging container advantageously reduces the number of containers that must be monitored. Different types of petroleum impacted waste may be consolidated in the same aging container.

In embodiments of the present invention, the petroleum impacted material is stored and passively ventilated in the aging container until the petroleum impacted material has a achieved a predetermined flashpoint. This process may be referred to as aging the petroleum impacted material. During aging, the lid or any other covering may be removed when the environment permits, such as when there is no precipitation, and a user is present to cover up the aging container in case precipitation is forecast or the conditioning site is unattended. One of ordinary skill in the art understands that passive ventilation is most effective when the lid or covering is removed. Accordingly, it is desirable to promote aging of the petroleum impacted material by having it be uncovered as frequently as possible. Typically, lids would be removed during active business hours where on-site support is provided. Otherwise, the lids would be in place for safety purposes.

According to some embodiments of the present invention, the aging process for the petroleum impacted material may be aged and monitored for a period of 4 weeks or greater. In other embodiments, 6 weeks or greater. In other embodiments, 8 weeks or greater.

According to some embodiments of the present invention, the aged petroleum impacted material is sampled and tested to test the properties of the aged petroleum impacted material. In some embodiments, sampling includes performing a composite analysis of samples collected from various sample locations within the aging container. In these and other embodiments, the composite sampling includes 8 sample locations or more. In other embodiments, 10 sample locations or more. In other embodiments, 12 sample locations or more. In other embodiments, 14 sample locations or more. In other embodiments, 16 sample locations or more. During sampling and testing, the values of the various samples may be compared to a reference data of previous aged petroleum impacted material samples collected when analyzing previous operations. Typically, the analysis of these samples is to confirm the moisture content and that the flashpoint has achieved a predetermined value. In some embodiments, the predetermined value of the flashpoint is 140 degrees Fahrenheit or greater. If the aged petroleum impacted material is determined to have a flashpoint below the predetermined value, it is further aged for a period of at least two weeks, after which sampling and testing is again performed until the material satisfies the testing and is useful as a fuel.

Sampling locations, which may be referred to as material grab points, are selected in order to have a composite understanding of the conditions of the aged petroleum impacted material within the aging container. One of ordinary skill in the art readily appreciates that environmental conditions including air temperature, humidity, wind, and others affect the rate of the aging process.

Once the aged petroleum impacted material has achieved the predetermined flashpoint, it is considered an alternative fuel and is profiled as such. Once the profiling process confirms its status as an alternative fuel the aged petroleum impacted material may be accepted by an alternative energy facility as a fuel for producing energy which is used to produce power or in other energy recovery processes. Once confirmed to be an alternative fuel, the entirety of the contents of the aging container may be transported to an alternative energy facility without being subject to DOT regulation and used in alternative energy processes.

FIG. 1 is a flow chart illustrating a method of handling and managing a petroleum impacted material to generate an alternative fuel according to an embodiment of the present invention. Step 101 includes acquiring petroleum impacted absorbent materials, which includes receiving a shipment of petroleum impacted absorbent materials in containers at a conditioning facility. Step 102 includes testing the received petroleum impacted absorbent materials for suitability of use with the present invention. If the received petroleum impacted absorbent materials are deemed not suitable for use with the present invention, they are rejected under Step 103 and managed as a solid/hazardous waste according to the appropriate procedures. Step 104 includes the beginning of the aging process where petroleum impacted absorbent materials deemed suitable during step 102 a placed in an aging container. Step 105 includes allowing the petroleum impacted absorbent materials to passively age in the aging container. During step 105, the moisture content is controlled by covering the petroleum impacted absorbent materials contained in the aging container during precipitation or when the facility is not actively staffed. After aging occurs, the aged petroleum impacted absorbent materials are tested to determine the flash point in step 107. If the flash point is not acceptable, the petroleum impacted materials are allowed to further age in accordance with step 105. Once the flash point is determined acceptable under step 107, it is suitable for shipping from the conditioning facility for use as an alternative fuel under step 108.

Embodiments of the present invention where the aging container is a roll-off container advantageously simplify transport of the aged petroleum impacted material to the alternative energy facility.

Various modifications and alterations that do not depart from the scope and spirit of this invention will become apparent to those skilled in the art. This invention is not to be duly limited to the illustrative embodiments set forth herein.

What is claimed is:

1. A method of generating an alternative fuel, the method comprising:

providing at least one petroleum impacted material;

identifying and classifying the at least one petroleum impacted material, wherein the at least one petroleum impacted material is classified as acceptable or unacceptable;

optionally, rejecting any of the at least one petroleum material classified as unacceptable;

handling any of the at least one acceptable petroleum impacted material, wherein handling includes dispersing the at least one acceptable petroleum impacted material in an aging container; and aging the at least one acceptable petroleum impacted material until a predetermined flashpoint value is obtained to thereby provide an aged petroleum impacted material as the alternative fuel.

2. The method of claim 1, wherein the at least one petroleum impacted material comprises an absorbent material contacted with a petroleum product.

3. The method of claim 2, wherein the absorbent material is characterized as having a net heating value of 3500 Btu/lb or greater.

4. The method of claim 3, wherein the absorbent material is characterized as having a net heating value of 5000 Btu/lb or greater.

5. The method of claim 2, wherein the absorbent material is a loose absorbent material.

6. The method of claim 5, wherein the loose absorbent material comprises organic material.

7. The method of claim 6, wherein the organic material is selected from the group consisting of ground corn cob, peat moss, coconut shells, and mixtures thereof.

8. The method of claim 2, wherein the petroleum product includes one or more gasoline, diesel, jet fuels, kerosene, unused motor oils, hydraulic oils and other uncontaminated petroleum products.

9. The method of claim 1, wherein the step of dispersing the at least one acceptable petroleum impacted material in an aging container results in the at least one acceptable petroleum impacted material being loosely dispersed in the aging container to thereby provide passive ventilation of the at least one acceptable petroleum impacted material during the step of aging.

10. The method of claim 1, wherein aging the at least one acceptable petroleum impacted material includes passive ventilation and drying of the at least one acceptable petroleum impacted material.

11. The method of claim 1, wherein during the step of aging a lid of the aging container is selectively opened and closed to provide ventilation and drying while rejecting infiltration of moisture to the at least one acceptable petroleum impacted material during the aging process.

12. The method of claim 1, wherein during the step of aging, the at least one acceptable petroleum impacted material in the aging container is sampled and analyzed.

13. The method of claim 1, wherein the analysis of samples of the at least one acceptable petroleum impacted material includes comparing values obtained during sampling against reference values to determine the aging conditions.

* * * * *